US007986292B2

(12) United States Patent
Furuhashi et al.

(10) Patent No.: US 7,986,292 B2
(45) Date of Patent: Jul. 26, 2011

(54) LIQUID CRYSTAL DISPLAY DEVICE EMPLOYING AN ANALOG INTERFACE TO WHICH A GRADATION VOLTAGE IS INPUT FROM OUTSIDE

(75) Inventors: Tsutomu Furuhashi, Yokohama (JP); Yoshio Oowaki, Mobara (JP); Takeshi Harayama, Mobara (JP)

(73) Assignee: Hitachi Displays, Ltd., Chiba-ken (JP)

( * ) Notice: Subject to any disclaimer, the term of this patent is extended or adjusted under 35 U.S.C. 154(b) by 890 days.

(21) Appl. No.: 11/984,259

(22) Filed: Nov. 15, 2007

(65) Prior Publication Data

US 2008/0129715 A1 Jun. 5, 2008

(30) Foreign Application Priority Data

Nov. 30, 2006 (JP) ..... 2006-323542

(51) Int. Cl.
*G09G 3/36* (2006.01)

(52) U.S. Cl. ..... 345/100; 345/89

(58) Field of Classification Search ..... 345/92, 345/204, 100, 103, 213, 215; 257/59, 72
See application file for complete search history.

(56) References Cited

U.S. PATENT DOCUMENTS

| | | | | |
|---|---|---|---|---|
| 6,411,346 | B1 * | 6/2002 | Numano et al. | 349/39 |
| 2001/0017608 | A1 * | 8/2001 | Kogure et al. | 345/87 |
| 2003/0151572 | A1 * | 8/2003 | Kumada et al. | 345/87 |
| 2004/0233151 | A1 * | 11/2004 | Hector et al. | 345/87 |
| 2005/0206597 | A1 * | 9/2005 | Ishii | 345/87 |
| 2006/0187171 | A1 * | 8/2006 | Kawata | 345/98 |
| 2006/0202936 | A1 * | 9/2006 | Chen et al. | 345/100 |

* cited by examiner

*Primary Examiner* — Chanh Nguyen
*Assistant Examiner* — John C Kirkpatrick
(74) *Attorney, Agent, or Firm* — Stites & Harbison PLLC; Juan Carlos A. Marquez, Esq.

(57) ABSTRACT

An image line driving circuit has: an n-number of switching elements for sampling a k-number of gradation voltages inputted from outside and then sequentially supplying the gradation voltages to first to (n/k)-th groups of a k-number of image lines; and a shift register circuit for sequentially inputting sampling voltages to first to (n/k)-th groups of a k-number of switching elements to thereby sequentially turn ON the respective groups of a k-number of switching elements. The scanning line driving circuit sequentially supplies selected scanning voltages to an m-number of scanning lines. The image line driving circuit and the scanning line driving circuit are circuits built in a semiconductor chip mounted on the first substrate. A thin-film transistor has a semiconductor layer formed of amorphous silicon. When voltage levels of the k-number of gradation voltages inputted from outside are at 0 to 5V, the selected scanning voltages inputted to the gates of the thin-film transistors are 20V or more.

10 Claims, 5 Drawing Sheets

Legend
111: Horizontal Shift Register
121: Vertical Shift Register
122: Level Shift Circuit
130: Step-up Circuit

LIQUID CRYSTAL DISPLAY DEVICE EMPLOYING AN ANALOG INTERFACE TO WHICH A GRADATION VOLTAGE IS INPUT FROM OUTSIDE

CLAIM OF PRIORITY

The present application claims priority from Japanese Application JP 2006-323542 filed on Nov. 30, 2006, the content of which is hereby incorporated by reference into this application.

BACKGROUND OF THE INVENTION

1. Technical Field of the Invention

The present invention relates to a liquid crystal display device, and more specifically to an effective technology for application to a liquid crystal display device employing an analog interface to which a gradation voltage is inputted from outside.

2. Description of Related Arts

Liquid crystal display devices are mainly classified into: those of a type to which display data (digital data) is inputted from outside; and those of a type (hereinafter, referred to as liquid crystal display devices for analog interface application) to which a gradation voltage (analog image voltage) is inputted from outside.

In the liquid crystal display device for analog interface application, gradation voltages are inputted from outside; therefore, a shift register circuit and a switching element for distributing the gradation voltages inputted from outside to respective image lines need to be provided on the liquid crystal display device side.

On the other hand, in an active-matrix-type liquid crystal display panel, each sub pixel has a thin-film transistor. As this thin-film transistor, those having a semiconductor layer formed of amorphous silicon and those having a semiconductor layer formed of polysilicon are well-known.

Hereinafter, a thin-film transistor having a semiconductor layer formed of amorphous silicon is referred to as an a-Si transistor, a liquid crystal display device using an a-Si transistor as an active element is referred to as an a-Si transistor, a thin-film transistor having a semiconductor layer formed of polysilicon is referred to as a p-Si transistor, and a liquid crystal display device using a p-Si transistor as an active element is referred to as a p-Si liquid crystal display device.

The aforementioned liquid crystal display device for analog interface application is required to sequentially sample analog gradation voltages inputted from outside to write them into respective sub pixels in one display line within one scanning period.

However, due to a small degree of movement of the a-Si transistor, in a case where the a-Si liquid crystal display device is used as a liquid crystal display device for analog interface application, analog gradation voltages inputted from outside cannot be sequentially sampled to be written into respective sub pixels in one display line within one scanning period.

Thus, as a conventional liquid crystal display device for analog interface application, the p-Si liquid crystal display device is used.

Further, in this p-Si liquid crystal display device, a shift register circuit and a switching element for distributing gradation voltages inputted from outside to respective image lines and also a scanning line driving circuit (shift register) for driving scanning lines are integrally formed on a substrate where the p-Si transistor is formed.

A liquid crystal display panel of the p-Si liquid crystal display device and a liquid crystal display panel of the a-Si liquid crystal display device are both fabricated by photolithography techniques. To fabricate the liquid crystal display panel of the p-Si liquid crystal display device, approximately ten masks are typically used.

Thus, the p-Si liquid crystal display device for analog interface application, suffers from difficulties in achieving cost reduction and poses a problem of deteriorated throughput.

Use of the a-Si liquid crystal display device as the liquid crystal display device for analog interface application permits achieving cost reduction and also improving throughput. However, as described above, due to a small degree of movement of the a-Si transistor, the a-Si liquid crystal display device fails to sequentially sample analog gradation voltages inputted from outside to write them into respective sub pixels in one display line within one scanning period.

SUMMARY OF THE INVENTION

To solve the problem described above, the present invention has been made, and it is an object of the invention to provide a technology that permits achieving cost reduction and improving throughput by using, as a liquid crystal display device for analog interface application, a liquid crystal display device whose sub pixels each have a thin-film transistor having a semiconductor layer formed of amorphous silicon.

The aforementioned and other objects and new features of the invention will be clarified with reference to the description of this specification and the accompanying drawings.

Of the invention disclosed in this application, the outline of those representing the invention will be described briefly below.

(1) There are provided: a liquid crystal display panel having a first substrate, a second substrate, and a crystal sandwiched between the first substrate and the second substrate; an image line driving circuit; and a scanning line driving circuit. The liquid crystal display panel further has: an (m×n)-number of sub pixels respectively having thin-film transistors; an m-number of scanning lines for inputting selected scanning voltages to gates of the thin-film transistors of the (m×n)-number of sub pixels; and an n-number of image lines for inputting image voltages to first electrodes of the thin-film transistors of the (m×n)-number of sub pixels. The image line driving circuit has: an n-number of switching elements for sampling a k-number of gradation voltages inputted from outside and then sequentially supplying the gradation voltages to groups of the k-number of image lines into which the n-number of image lines are divided (where k is smaller than n), the groups including first to (n/k)-th groups; and a shift register circuit for sequentially inputting sampling voltages to groups of a k-number of switching elements into which the n-number of switching elements are divided to thereby sequentially turn on the groups of a k-number of switching elements, the groups including first to (n/k)-th groups. The scanning line driving circuit is a liquid crystal display device sequentially supplying selected scanning voltages to the m-number of scanning lines. The image line driving circuit and the scanning line driving circuit are circuits built in a semiconductor chip mounted on the first substrate. The thin-film transistor has a semiconductor layer formed of amorphous silicon. When voltage levels of the k-number of gradation voltages inputted from outside are at 0 to 5V, the selected scanning voltages inputted to the gates of the thin-film transistors are 20V or more.

(2) In (1), a period during which each of the switching elements is ON is equal to 200 ns or more.

(3) In (1) or (2), there is further provided means adapted to pre-charge each of the image lines before the gradation voltages are supplied to the respective image lines within one scanning period.

(4) In any of (1) to (3), the semiconductor chip has a step-up circuit, and the scanning line driving circuit has a level shift circuit for, based on a voltage generated by the step-up circuit, converting a low level selected scanning voltage into a selected scanning voltage at a level as high as the value 20V or more.

(5) In any of (1) to (4), the image line driving circuit and the scanning line driving circuit are circuits built in a same semiconductor chip mounted on the first substrate, the image line driving circuit is arranged at a center of the semiconductor chip in a longer direction thereof, and the scanning line driving circuit is arranged on both outer sides of a region on the semiconductor chip where the image line driving circuit is arranged.

(6) In any of (1) to (5), where wiring resistance of the image lines is R and wiring capacitance thereof is C, R×C is 75 ns or less.

(7) In any of (1) to (6), at least either of the image lines or the scanning lines are formed of an Al—Cu multilayered wiring layer.

(8) There are provided: a liquid crystal display panel having a first substrate, a second substrate, and a crystal sandwiched between the first substrate and the second substrate; an image line driving circuit; and a scanning line driving circuit. The liquid crystal display panel further has: an (m×n)-number of sub pixels respectively having thin-film transistors; an m-number of scanning lines for inputting selected scanning voltages to gates of the thin-film transistors of the (m×n)-number of sub pixels; and an n-number of image lines for inputting image voltages to first electrodes of the thin-film transistors of the (m×n)-number of sub pixels. The image line driving circuit has: an n-number of switching elements for sampling a k-number of gradation voltages inputted from outside and then sequentially supplying the gradation voltages to groups of the k-number of image lines into which the n-number of image lines are divided (where k is smaller than n), the groups including first to (n/k)-th groups; and a shift register circuit for sequentially inputting sampling voltages to groups of a k-number of switching elements into which the n-number of switching elements are divided to thereby sequentially turn on the groups of a k-number of switching elements, the groups including first to (n/k)-th groups. The scanning line driving circuit is a liquid crystal display device sequentially supplying selected scanning voltages to the m-number of scanning lines. The image line driving circuit and the scanning line driving circuit are circuits built in a semiconductor chip mounted on the first substrate. The selected scanning voltages inputted to the gates of the thin-film transistors are equal to or more than twice a level of the k-number of gradation voltages inputted from outside.

(9) There are provided: a liquid crystal display panel having a first substrate, a second substrate, and a crystal sandwiched between the first substrate and the second substrate; an image line driving circuit; and a scanning line driving circuit. The liquid crystal display panel further has: an (m×n)-number of sub pixels respectively having thin-film transistors; an m-number of scanning lines for inputting selected scanning voltages to gates of the thin-film transistors of the (m×n)-number of sub pixels; and an n-number of image lines for inputting image voltages to first electrodes of the thin-film transistors of the (m×n)-number of sub pixels. The image line driving circuit has: an n-number of switching elements for sampling a k-number of gradation voltages inputted from outside and then sequentially supplying the gradation voltages to groups of the k-number of image lines into which the n-number of image lines are divided (where k is smaller than n), the groups including first to (n/k)-th groups; and a shift register circuit for sequentially inputting sampling voltages to groups of a k-number of switching elements into which the n-number of switching elements are divided to thereby sequentially turn on the groups of a k-number of switching elements, the groups including first to (n/k)-th groups. The scanning line driving circuit is a liquid crystal display device sequentially supplying selected scanning voltages to the m-number of scanning lines. The image line driving circuit and the scanning line driving circuit are circuits built in a semiconductor chip mounted on the first substrate. A period during which each of the switching elements is ON is a period of one k-th or less of one horizontal scanning period. Where wiring resistance of the image lines is R and wiring capacitance thereof is C, R×C is a time constant equal to one third or less of the period during which the switching element is ON.

Advantages provided by those representing the invention disclosed in this application will be described briefly below.

According to the invention, in a liquid crystal display device for analog interface application, lower cost and improved throughput can be achieved.

DETAILED DESCRIPTION OF THE PREFERRED EMBODIMENTS

Hereinafter, the embodiment of the present invention will be described with reference to the accompanying drawings.

In all the figures illustrating the embodiment, those having the same function are provided with the same numerals and their repeated description will be omitted.

Figure 1:
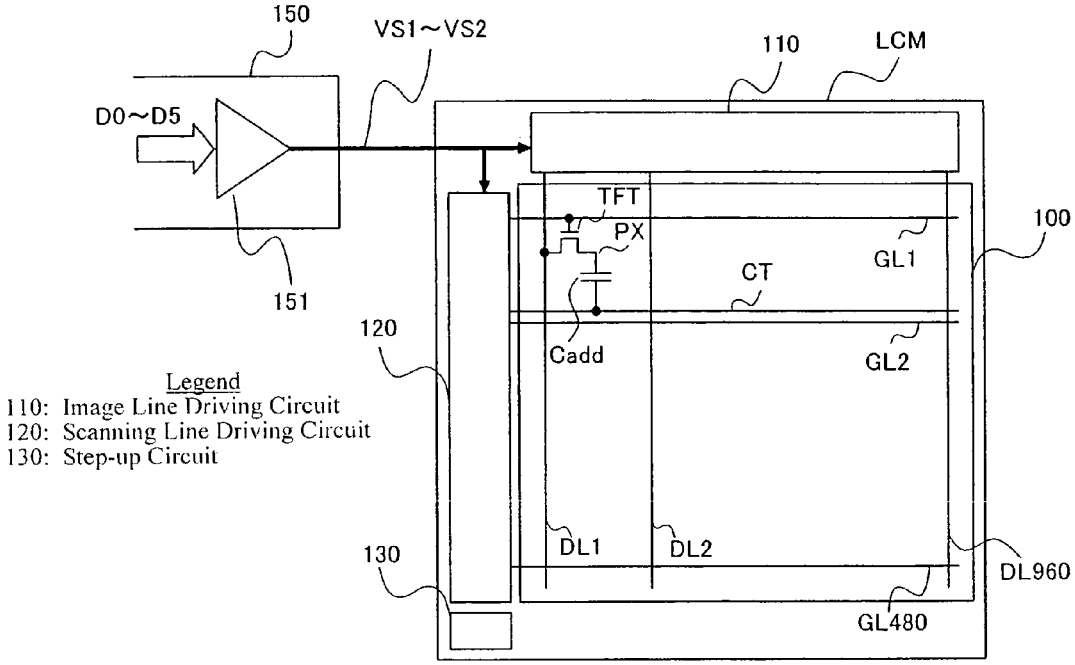
FIG. 1 is a block diagram showing overall schematic configuration of a liquid crystal display module according to an embodiment of the present invention.

FIG. 1 is a block diagram showing overall schematic configuration of a liquid crystal display module according to the embodiment of the invention.

In FIG. 1, LCM denotes the liquid crystal display module of this embodiment, 100 denotes a display part, 110 denotes an image line driving circuit, 120 denotes a scanning line driving circuit, 130 denotes a step-up circuit, and 150 denotes a body side system board.

The body side system board 150 converts, for example, six bits of display data D0 to D5 into gradation voltages (socalled analog image voltages) with a D/A converter 151, and then transfers them to the liquid crystal display module (LCM). In this case, as described below, by using 12 transmission lines, 12 gradation voltages are transferred simultaneously from the body side system board 150 to the liquid crystal display module (LCM).

The display part 100 of the liquid crystal display module (LCM) has: an n-number (here, 320×3=960) of image lines (DL), an m-number (here, 480) of scanning lines (GL), plural (here, 320×480×3) sub pixels arranged in a matrix form. Each of the sub pixels is arranged at a region surrounded by the corresponding image lines (DL) and the corresponding scanning lines (GL).

Each sub pixel has a thin-film transistor (TFT) forming an active element, and gates of 960 thin-film transistors (TFT) in each row are each connected to the corresponding scanning line (GL), which is connected to the scanning line driving circuit 120. Each thin-film transistor (TFT) is energized when a positive bias voltage is applied to its gate and not energized when a negative bias voltage is applied thereto.

First electrodes (drains or sources) of 480 thin-film transistors (TFT) in each column are each connected to the corresponding image line (DL), which is connected to the image line driving circuit 110.

Between a pixel electrode (PX) and a counter electrode (CT), a liquid crystal layer is provided. Thus, to each pixel electrode (PX), a liquid crystal capacitance is connected in an equalizing manner, and also a holding capacitance (Cadd) is connected between the pixel electrode (PX) and the counter electrode (CT).

Figure 2:
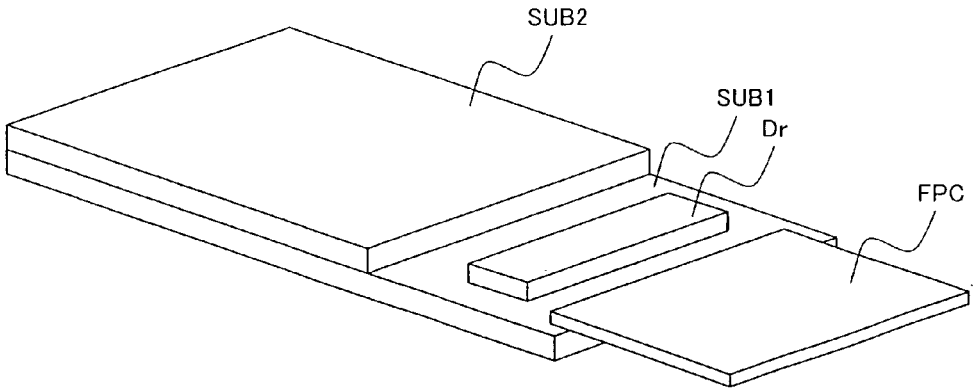
FIG. 2 is a perspective view showing schematic configuration of the liquid crystal display module according to the embodiment of the invention.

FIG. 2 is a perspective view showing schematic configuration of the liquid crystal display module of this embodiment.

The liquid crystal display module of this embodiment is a liquid crystal display module of an IPS-type. Although omitted from the illustration, on a first substrate (SUB1), pixel electrodes (PX), thin-film transistors (TFT), counter electrodes (CT), image lines (DL), scanning lines (GL), and holding capacitances (Cadd) are formed. On a second substrate (SUB2), a color filter, a light-shielding film, etc. are formed.

As shown in FIG. 2, the liquid crystal display module of this embodiment is formed by laying, one on another, the first substrate (SUB1) (also referred to as a TFT substrate or active matrix substrate) and the second substrate (SUB2) (also referred to as a counter substrate) at a predetermined interval therebetween and attaching the two substrates together with a sealant provided in a frame-like form near the peripheral part between the two substrates, and then including a liquid crystal inside the sealant between the two substrates through a liquid crystal including port provided in part of the sealant, then enclosing it, and further attaching a polarization plate to outer sides of the two substrates.

In this manner, the liquid crystal display module of this embodiment is structured with the liquid crystal sandwiched between the pair of substrates, and the main surface side of the second substrate (SUB2) serves as a display surface.

The second substrate (SUB2) has a larger area than the first substrate (SUB1), and at a region of the second substrate (SUB2) not facing the first substrate (SUB1), a semiconductor chip (Dr) is mounted, and further at one peripheral side of this region, a flexible wiring board (FPC) is mounted. The material of the board is not limited to glass and thus may be plastic or the like, as long as it has insulation properties.

Figure 3:
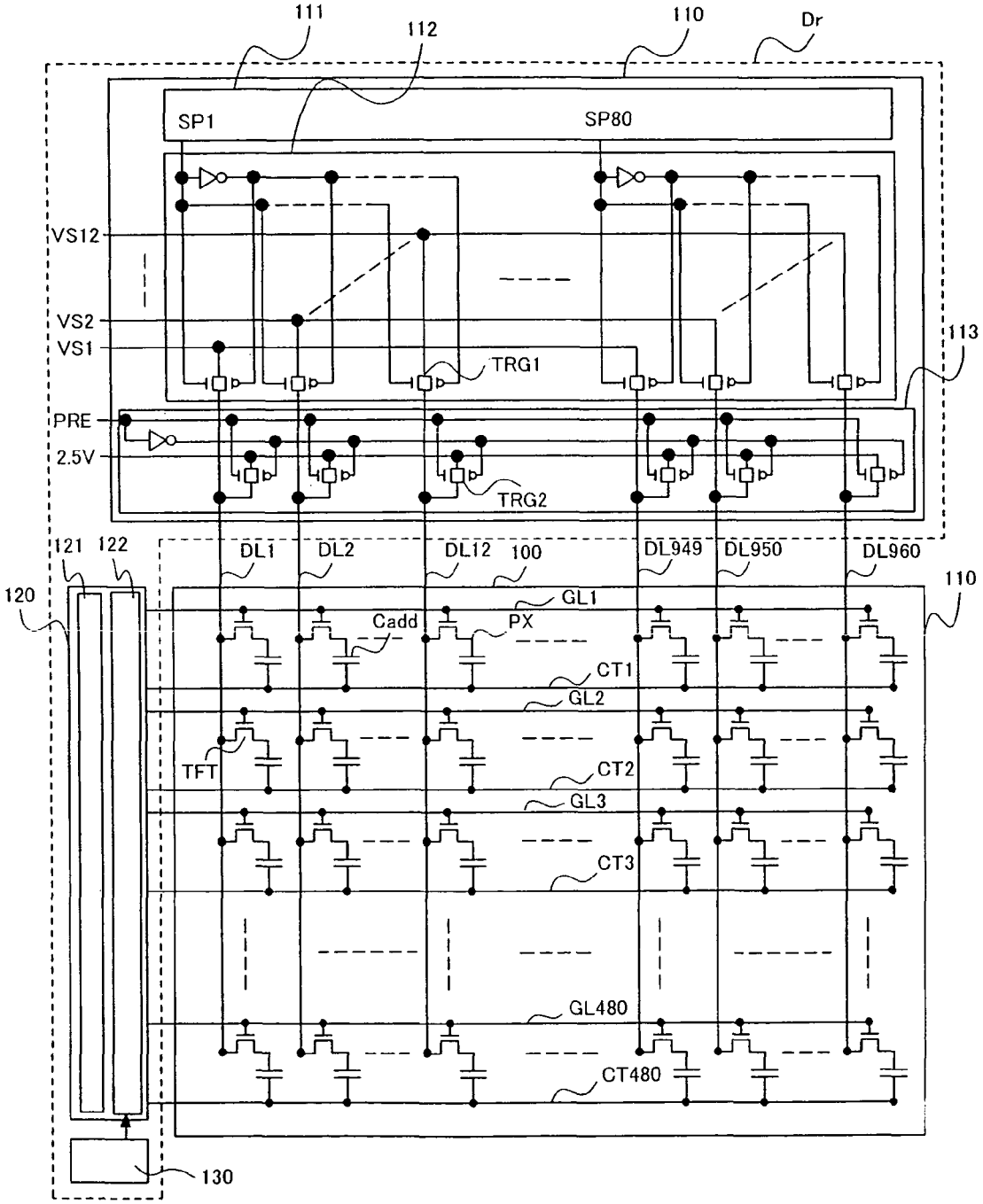
FIG. 3 is a block diagram showing inner circuit configuration of an image line driving circuit and a scanning line driving circuit shown in FIG. 1.

FIG. 3 is a block diagram showing inner circuit configuration of the image line driving circuit 110 and the scanning line driving circuit 120 shown in FIG. 1. A portion indicated by a dotted frame in FIG. 3 corresponds to circuits built in the semiconductor chip (Dr) of FIG. 2.

As shown in FIG. 3, the image line driving circuit 110 is composed of: a horizontal shift register 111, a switching circuit 112, and a precharge circuit 113.

VS1 to VS12 shown in FIG. 3 denote video signal lines, and the switching circuit 112 is composed of 960 transfer gate circuits (TRG1) that connect the image lines (DL1 to DL960) to the video signal lines (VS1 to VS12). In this case, the 960 image lines (DL) are divided into 80 groups each composed of 12 image lines. The 12 image lines (DL) in each of the groups are connected to their respective corresponding video signal lines (VS1 to VS12).

The horizontal shift resistor 111 respectively inputs first to $80^{th}$ sampling pulses (SP1 to SP80) to groups of 12 transfer gate circuits (TRG1) respectively connected to the first to $80^{th}$ groups of the image lines (DL) to supply gradation voltages to the first to $80^{th}$ groups of 12 image lines (DL).

For example, in FIG. 3, the 12 transfer gate circuits (TRG1) connected to the image lines (DL1 to DL12) of the first group are turned ON with the first sampling pulse (SP1). While this first sampling pulse (SPF) is at "High level", gradation voltages are respectively supplied to the image lines (DL1 to DL12) from the corresponding video signal lines (VS1 to VS12).

The precharge circuit 113 is formed of transfer gate circuits (TRG2) that connect, within a precharge period, the image lines (DL1 to DL960) to a power supply line to which a precharge voltage of 2.5V is supplied.

As shown in FIG. 3, the scanning line driving circuit 120 is composed of a vertical shift register 121 and a level shift circuit 122.

The vertical shift register 121 sequentially outputs low-level selected scanning voltages. The level shift circuit 122, based on a high voltage outputted from the step-up circuit 130, converts a low-level selected scanning voltage into a high-level selected scanning voltage, and then supplies it to each of the scanning lines (GL).

As a result, the thin-film transistor (TFT) of each of the sub pixels in one display line, the gate of which thin-film transistor is supplied with the high-level selected scanning voltage, turns ON during one horizontal scanning period.

As shown in FIG. 3, the counter electrodes (CT) are composed of 480 counter electrodes (CT1 to CT480) divided for respective display lines.

Moreover, with the driving method of this embodiment, a counter voltage (VCOM) of a positive polarity and a counter voltage (VCOM) of a negative polarity are inputted to the counter electrodes (CT) alternately every display line. Accordingly, the polarities of the gradation voltages inputted to the video signal lines (VS1 to VS12) vary every display line, and thus a gradation voltage of a positive polarity and a gradation voltage of a negative polarity are alternately inputted to the video signal lines (VS1 to VS12).

Figure 4:
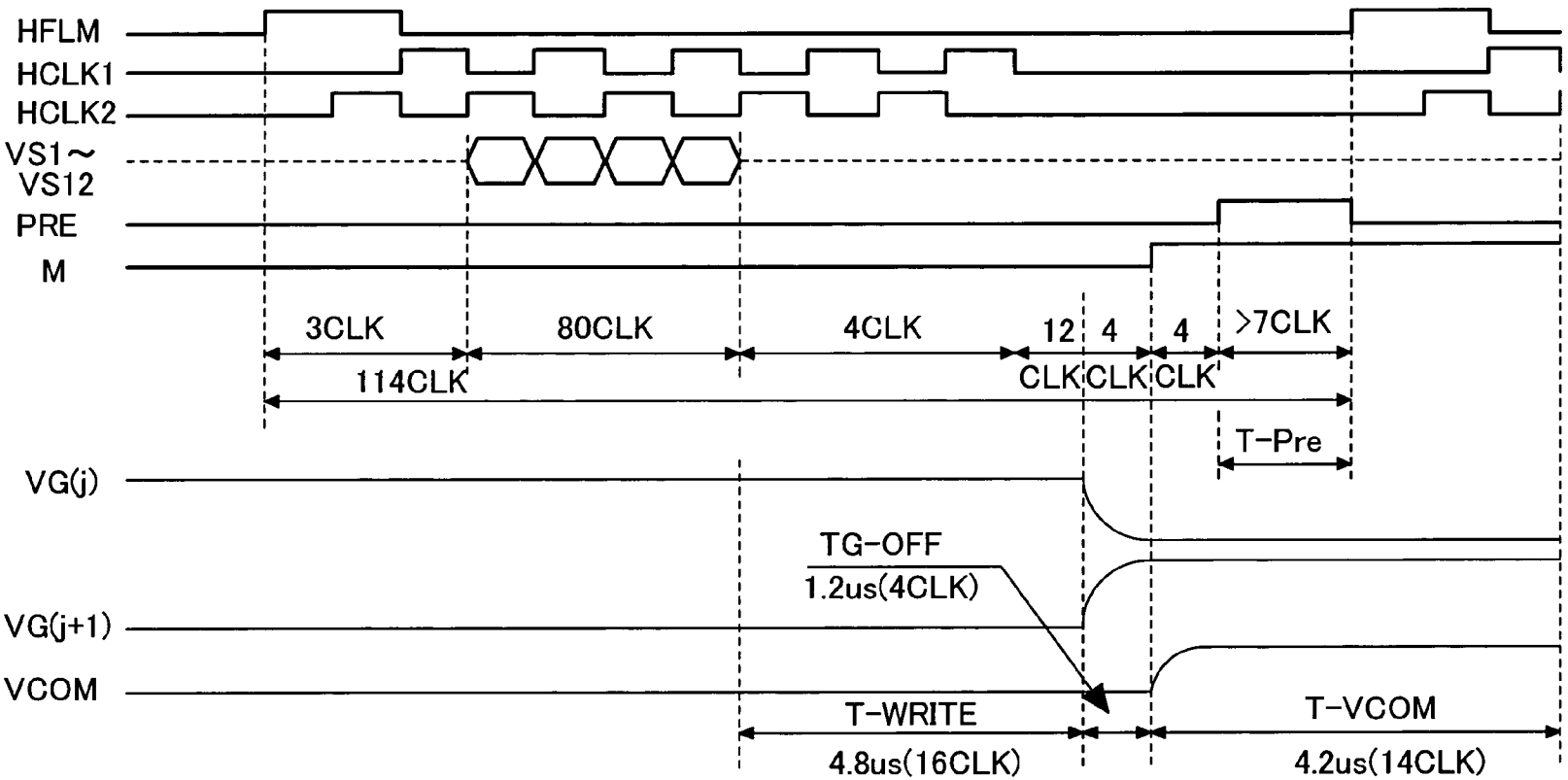
FIG. 4 is a timing chart illustrating operation of the liquid crystal display module according to the embodiment of the invention.

FIG. 4 is a timing chart illustrating operation of the liquid crystal display module (LCM) of this embodiment.

In FIG. 4, HFLM denotes a horizontal synchronizing signal, HCLK1 and HCLK2 denote clocks synchronous with the gradation voltages inputted to the video signal lines (VS1 to VS12). The clock (HCLK1) and the clock (HCLK2) have the same frequency, but have mutually inverted phases. CLK in FIG. 4 indicates half a cycle of the clock (HCLK1) or the clock (HCLK2). Here, the transfer speed of the gradation voltages is 3 MHz; thus, 1 CLK is 300 ns.

As shown in FIG. 4, after a period of 3 CLK since the horizontal synchronizing signal (HFLM) has been inputted, gradation voltages are supplied from the video signal lines (VS1 to VS12) 80 times within a period of 80 CLK to the 960 image lines (DL). That is, a period during which the transfer gate circuits (TRG1) are ON is a period equivalent to one eightieth or less of one horizontal scanning period.

Then after a period of 24 CLK since the gradation voltages have been supplied to the image lines (DL949 to 960) of the last group, a control signal (PRE) turns ON, and a precharge voltage of 2.5V is supplied to the 960 image lines (DL). Here, the precharge period is preferably a period equal to 7 CLK or longer.

In FIG. 4, T-WRITE denotes pixel writing time, i.e., a period (here, indicated as 16 CLK) from the time when the gradation voltages are supplied to the image lines (DL949 to 960) of the last group to the time when a negative scanning voltage is inputted to the scanning lines (GL) and then the thin-film transistors turn OFF.

TG-OFF denotes a gate off time, i.e., a period (here, 4CLK) from the time when a negative scanning voltage is inputted to the j-th scanning line (GL) and a selected scanning voltage is inputted to the (j+1)-th scanning line (GL) to the time when an alternating signal (M) changes.

Further, T-VCOM denotes a voltage stable time for the counter electrodes (CT), i.e., period (here, 14 CLK) from the time when the voltages of the counter electrodes (CT) switch to the time when the gradation voltages are introduced from the video signal lines (VS1 to VS12) to the image lines (DR).

In this embodiment, as the thin-film transistor (TFT) of each of the sub pixels shown in FIGS. 1 and 3, a thin-film transistor having a semiconductor layer formed of amorphous silicon (a-Si transistor) is used.

However, as described above, due to a small degree of movement of the a-Si transistor, in a case where the horizontal shift register 111 and the switching circuit 112 shown in FIG. 3 are each formed of an a-Si transistor, operation of introducing the gradation voltages inputted to the video signal lines (VS1 to VS12) cannot be executed within one scanning period.

Similarly, in a case where the vertical shift register 121 and the level shift circuit 122 are each formed of an a-Si transistor, scanning operation with the scanning lines (GL) cannot be executed within one frame period.

Thus, in this embodiment, the image line driving circuit 110 and the scanning line driving circuit 120 shown in FIGS. 1 and 3 are defined as circuits built in the semiconductor chip (Dr) shown in FIG. 2.

The image line driving circuit 110 and the scanning line driving circuit 120 shown in FIGS. 1 and 3 can also be built in different semiconductor chips. For example, the image line driving circuit 110 shown in FIGS. 1 and 3 may be built in the first semiconductor chip, and the scanning line driving circuit 120 shown in FIGS. 1 and 3 may be built in the second semiconductor chip.

Figure 5A:
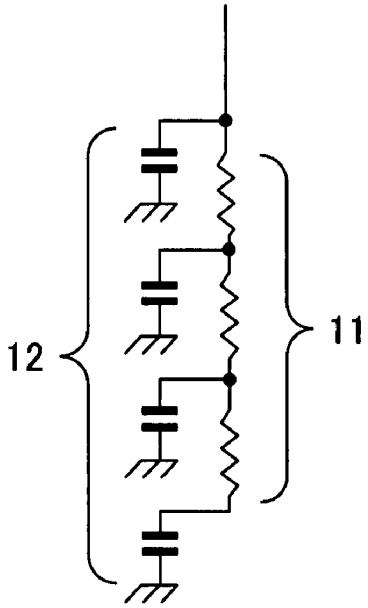
FIGS. 5A and 5B are diagrams showing an equivalent model of an image line (DL) according to the embodiment of the invention.
Figure 5B:
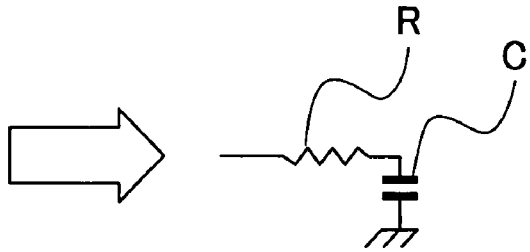
Figure 6:
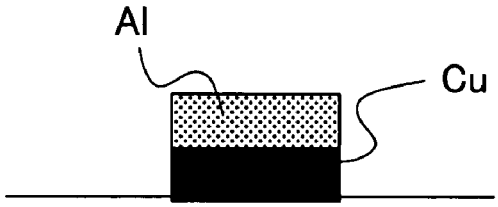
FIG. 6 is a sectional view showing one example of an image line (DL) according to the embodiment of the invention.

Typically, as shown in FIG. 5A, the image line (DL) can be considered as a distributed constant line composed of a wiring resistance group 11 and a wiring capacitance group 12. Now, as shown in FIG. 5B, assume that the wiring resistance of the image line (DL) is R, the wiring capacitance thereof is C, and a time constant is $\tau$(=R×C) as viewed from one terminal of the image line (DL) (terminal to which the gradation voltage is supplied). In this embodiment, $\tau$ is preferably equal to or less than a period of 100 ns (=300/3, that is, one third of the period during which the transfer gate circuit (TRG1) is ON). Further, in this embodiment, in a case where a pulsating voltage is inputted to one terminal of the image line (DL), in order that a charging voltage of the image line (DL) becomes a value equivalent to 98% of the inputted voltage within 1 CLK, a period of 4$\tau$ needs to be equal to 300 ns; therefore, $\tau$ is more preferably 75 (=300/4) ns or less.

That is, in this embodiment, though, for example, a method of increasing the thickness (lowering the resistance) of a single-layered wiring layer of Al, Cu, Mo, Cr, or the like or a double-layered wiring layer, such as an Al—Cu double-layered wiring layer, which is composed of two metals from among Al, Cu, Mo, Cr, and the like, the product of the wiring resistance R of the image line (DL) multiplied by the wiring capacitance C thereof ($\tau$=R×C) is set at 75 ns or less.

A time of 1 CLK depends on the number of gradation voltages (12 in this embodiment) simultaneously transferred from the body side system board 150 to the liquid crystal display module (LCM) (or depends on the transfer speed). Thus, if the number of gradation voltages simultaneously transferred from the body side system board 150 to the liquid crystal display module (LCM) is larger than 12, or if the transfer speed is lower than 300 MHz, the time of 1 CLK is longer, and thus the time constant $\tau$ can be larger than 75 ns.

In this embodiment, the thin-film transistor (TFT) of each of the sub pixels shown in FIGS. 1 and 3 is an a-Si transistor. Thus, in this condition without any change, the gradation voltages introduced from the video signal lines (VS1 to VS12) to the image lines (DL) cannot be written into the respective sub pixels while the thin-film transistors (TFT) are ON.

Thus, in this embodiment, a selected scanning voltage inputted to the gate of the thin-film transistor (TFT) of each sub pixel is set at a level twice or more the largest voltage level of the twelve gradation voltages inputted to the video signal lines (VS1 to VS12). More specifically, the selected scanning voltage inputted to the gate of the thin-film transistor (TFT) of each sub pixel is set at 20V or more when the voltage levels of the twelve gradation voltages inputted to the video signal line (VS1 to VS12) are at 0 to 5V.

Consequently, the ON resistance value of the a-Si transistor forming the thin-film transistor (TFT) of each sub pixel can be reduced, thus permitting the analog gradation voltages introduced from the video signal lines (VS1 to VS12) to be written into the respective sub pixels while the thin-film transistors (TFT) are ON.

Thus, as shown in FIGS. 1 and 3, the step-up circuit 130 is provided in the semiconductor chip (Dr), and a selected scanning voltage of 20V or more is generated.

Figure 7:
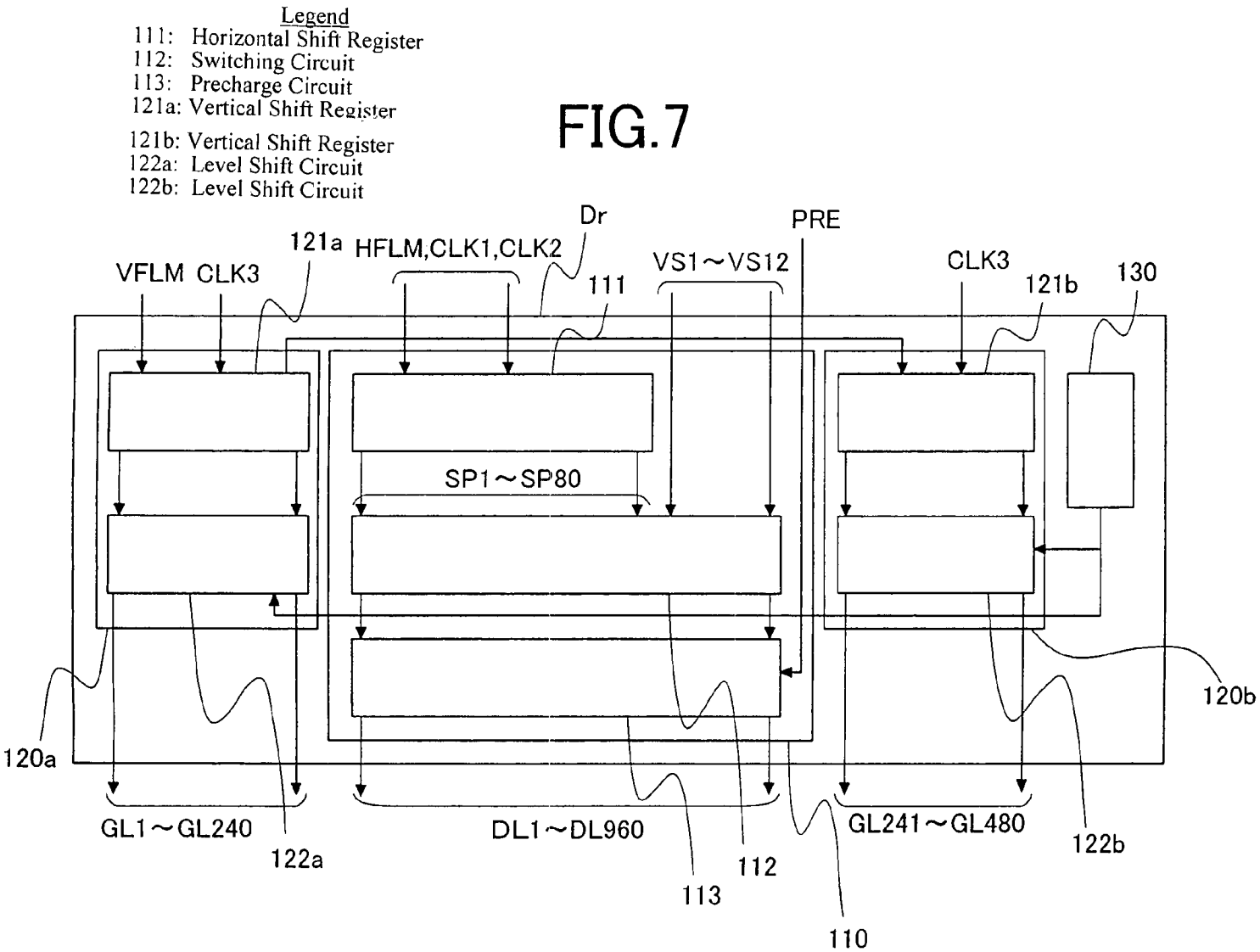
FIG. 7 is a block diagram showing one example of circuit configuration in a semiconductor chip (Dr) shown in FIG. 2.

FIG. 7 is a block diagram showing one example of circuit configuration in the semiconductor chip (Dr) shown in FIG. 2.

In the example shown in FIG. 7, the image line driving circuit 110 is arranged at the center of the semiconductor chip (Dr) in the longer direction thereof. The scanning line driving circuit 120 is divided into two, and the two divided scanning line driving circuits (scanning line driving circuit 120*a*, which includes a vertical shift register 121*a* and a level shift circuit 122*a*, and scanning line driving circuit 120*b*, which includes a vertical shift register 121*b* and a level shift circuit 122*b*) are arranged on the both sides of the semiconductor chip (Dr) in the longer direction thereof (that is, on the both sides of the image line driving circuit 110). The step-up circuit 130 is arranged on the outer side of the divided scanning line driving circuit (120*b*).

As described above, in this embodiment, the image line driving circuit 110 and the scanning line driving circuit 120 shown in FIGS. 1 and 3 are built in the semiconductor chip (Dr) shown in FIG. 2, and then only the thin-film transistor (TFT) of each sub pixel shown in FIGS. 1 and 3 is formed with an a-Si transistor.

In a process of manufacturing an a-Si transistor, in order to create patterns for sub pixel parts, wiring, and so on, fabrication is typically achieved through photolithography techniques by use of approximately five masks. Therefore, as compared to a case where a p-Si transistor is used, the number of masks can be reduced by half.

Moreover, in this embodiment, since the image line driving circuit 110 and the scanning line driving circuit 120 are formed with circuits built in the semiconductor chip (Dr), the process of manufacturing an a-Si transistor is required only for the display part 100.

Therefore, in this embodiment, it is possible to improve the throughput, increase the productivity, and achieve cost reduction.

The invention achieved by the inventor has been described in detail above, referring to the aforementioned embodiment. However, it is needless to say that the invention is not limited to this embodiment, and thus various modifications can be made without departing from the spirit of the invention.

What is claimed is:

1. A liquid crystal display device comprising:

a liquid crystal display panel having a first substrate, a second substrate, and a liquid crystal material sandwiched between the first substrate and the second substrate;

an image line driving circuit; and a scanning line driving circuit, wherein the liquid crystal display panel further has:

an (m×n)-number of sub pixels respectively having thin-film transistors;

an m-number of scanning lines for inputting selected scanning voltages to gates of the thin-film transistors of the (m×n)-number of sub pixels; and an n-number of image lines for inputting image voltages to first electrodes of the thin-film transistors of the (m×n)-number of sub pixels, the image line driving circuit has:

an n-number of switching elements for sampling a k-number of gradation voltages inputted from outside and then sequentially supplying the gradation voltages to groups of the k-number of image lines into which the n-number of image lines are divided (where k is smaller than n), the groups including first to (n/k)-th groups;

a shift register circuit for sequentially inputting sampling voltages to groups of a k-number of switching elements into which the n-number of switching elements are divided to thereby sequentially turn on the groups of a k-number of switching elements, the groups including first to (n/k)-th groups; and a pre-charge circuit supplying a pre-charge voltage to the image lines before the gradation voltages are supplied to the respective image lines within one scanning period, the gradation voltages are supplied to the respective image lines during (n/k) clocks, the pre-charge voltage is supplied to the respective image lines after 24 clocks from each (n/k)-th clock, the scanning line driving circuit is a liquid crystal display device sequentially supplying selected scanning voltages to the m-number of scanning lines, the image line driving circuit and the scanning line driving circuit are circuits built in a semiconductor chip mounted on the first substrate, the thin-film transistor has a semiconductor layer formed of amorphous silicon, and when voltage levels of the k-number of gradation voltages inputted from outside are at 0 to 5V, the selected scanning voltages inputted to the gates of the thin-film transistors are 20V or more.

2. The liquid crystal display device according to claim 1, wherein a period during which each of the switching elements is ON is equal to 200 ns or more.

3. The liquid crystal display device according to claim 2, wherein, where wiring resistance of the image lines is R and wiring capacitance thereof is C, R×C is 75 ns or less.

4. The liquid crystal display device according to claim 1, wherein the semiconductor chip has a step-up circuit, and the scanning line driving circuit has a level shift circuit for, based on a voltage generated by the step-up circuit, converting a low level selected scanning voltage into a selected scanning voltage at a level as high as the value 20V or more.

5. The liquid crystal display device according to claim 1, wherein the image line driving circuit and the scanning line driving circuit are circuits built in a same semiconductor chip mounted on the first substrate, the image line driving circuit is arranged at a center of the semiconductor chip in a longer direction thereof, and the scanning line driving circuit is arranged on both outer sides of a region on the semiconductor chip where the image line driving circuit is arranged.

6. The liquid crystal display device according to claim 1, wherein, where wiring resistance of the image lines is R and wiring capacitance thereof is C, R×C is 75 ns or less.

7. The liquid crystal display device according to claim 1, wherein at least either of the image lines or the scanning lines are formed of an Al—Cu multilayered wiring layer.

8. A liquid crystal display device comprising:

a liquid crystal display panel having a first substrate, a second substrate, and a liquid crystal material sandwiched between the first substrate and the second substrate;

an image line driving circuit; and a scanning line driving circuit, wherein the liquid crystal display panel further has:

an (m×n)-number of sub pixels respectively having thin-film transistors;

an m-number of scanning lines for inputting selected scanning voltages to gates of the thin-film transistors of the (m×n)-number of sub pixels; and an n-number of image lines for inputting image voltages to first electrodes of the thin-film transistors of the (m×n)-number of sub pixels, the image line driving circuit has:

an n-number of switching elements for sampling a k-number of gradation voltages inputted from outside and then sequentially supplying the gradation voltages to groups of the k-number of image lines into which the n-number of image lines are divided (where k is smaller than n), the groups including first to (n/k)-th groups; and a shift register circuit for sequentially inputting sampling voltages to groups of a k-number of switching elements into which the n-number of switching elements are divided to thereby sequentially turn on the groups of a k-number of switching elements, the groups including first to (n/k)-th groups; and a pre-charge circuit supplying a pre-charge voltage to the image lines before the gradation voltages are supplied to the respective image lines within one scanning period, the gradation voltages are supplied to the respective image lines during (n/k) clocks, the pre-charge voltage is supplied to the respective image lines after 24 clocks from each (n/k)-th clock, the scanning line driving circuit is a liquid crystal display device sequentially supplying selected scanning voltages to the m-number of scanning lines, the image line driving circuit and the scanning line driving circuit are circuits built in a semiconductor chip mounted on the first substrate, and the selected scanning voltages inputted to the gates of the thin-film transistors are equal to or more than twice a level of the k-number of gradation voltages inputted from outside.

9. A liquid crystal display device comprising:

a liquid crystal display panel having a first substrate, a second substrate, and a liquid crystal material sandwiched between the first substrate and the second substrate;

an image line driving circuit; and a scanning line driving circuit, wherein the liquid crystal display panel further has:

an (m×n)-number of sub pixels respectively having thin-film transistors;

an m-number of scanning lines for inputting selected scanning voltages to gates of the thin-film transistors of the (m×n)-number of sub pixels; and an n-number of image lines for inputting image voltages to first electrodes of the thin-film transistors of the (m×n)-number of sub pixels, the image line driving circuit has:

an n-number of switching elements for sampling a k-number of gradation voltages inputted from outside and then sequentially supplying the gradation voltages to groups of the k-number of image lines into which the n-number of image lines are divided (where k is smaller than n), the groups including first to (n/k)-th groups; and a shift register circuit for sequentially inputting sampling voltages to groups of a k-number of switching elements into which the n-number of switching elements are divided to thereby sequentially turn on the groups of a k-number of switching elements, the groups including first to (n/k)-th groups; and a pre-charge circuit supplying a pre-charge voltage to the image lines before the gradation voltages are supplied to the respective image lines within one scanning period, the gradation voltages are supplied to the respective image lines during (n/k) clocks, the pre-charge voltage is supplied to the respective image lines after 24 clocks from each (n/k)-th clock, the scanning line driving circuit is a liquid crystal display device sequentially supplying selected scanning voltages to the m-number of scanning lines, the image line driving circuit and the scanning line driving circuit are circuits built in a semiconductor chip mounted on the first substrate, a period during which each of the switching elements is ON is a period of one k-th or less of one horizontal scanning period, and where wiring resistance of the image lines is R and wiring capacitance thereof is C, R×C is a time constant equal to one third or less of the period during which the switching element is ON.

10. The liquid crystal display device according to claim 9, wherein, where wiring resistance of the image lines is R and wiring capacitance thereof is C, R×C is a time constant equal to one fourth or less of the period during which the switching element is ON.

* * * * *